US011384937B1

(12) United States Patent
Sampath et al.

(10) Patent No.: US 11,384,937 B1
(45) Date of Patent: Jul. 12, 2022

(54) SWIRLER WITH INTEGRATED DAMPER

(71) Applicant: General Electric Company, Schenectady, NY (US)

(72) Inventors: Karthikeyan Sampath, Karnataka (IN); Ugandhar K. Reddy, Southampton (GB); Steven C. Vise, Loveland, OH (US); Allen M. Danis, Mason, OH (US); Kwanwoo Kim, Cincinnati, OH (US); Ranganatha Narasimha Chiranthan, Karnataka (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/318,801

(22) Filed: May 12, 2021

(51) Int. Cl.
*F23R 3/14* (2006.01)
*F23R 3/26* (2006.01)

(52) U.S. Cl.
CPC . *F23R 3/14* (2013.01); *F23R 3/26* (2013.01)

(58) Field of Classification Search
CPC .... F23R 3/14; F23R 3/28; F23R 3/283; F23R 3/286
See application file for complete search history.

(56) References Cited

U.S. PATENT DOCUMENTS 5,351,477 A * 10/1994 Joshi ..... F23D 17/002 60/737
5,675,971 A * 10/1997 Angel ..... F23R 3/286 60/737
5,778,676 A * 7/1998 Joshi ..... F23D 17/002 60/737
5,865,024 A * 2/1999 Kress ..... F23R 3/36 60/737
6,272,865 B1 8/2001 Clark et al.
8,061,142 B2 11/2011 Kastrup et al.
8,312,724 B2 11/2012 Dai et al.
9,745,936 B2 8/2017 Ryon et al.
9,920,932 B2 3/2018 Dai et al.
10,054,312 B2 8/2018 Dai et al.
2013/0071251 A1 3/2013 Relancio et al.
2018/0195728 A1 7/2018 Caruso et al.

OTHER PUBLICATIONS

Mironov et al., "One-dimensional acoustic waves in retarding structures with propagation velocity tending to zero," Acoustical Physics, vol. 48, No. 3, pp. 347-352 (2002).
Ouahabi et al., "Experimental investigation of the acoustic black hole for sound absorption in air," 22nd International Congress on Sound and Vibration, 8 pages (2015).
Sharma et al., "Analysis of Low Frequency Muffler based on 'Acoustic Black Hole Effect'," Proceedings of the Institute of Acoustics (2016).

* cited by examiner

*Primary Examiner* — William H Rodriguez
(74) *Attorney, Agent, or Firm* — Venable LLP; Elizabeth C. G. Gitlin; Michele V. Frank

(57) ABSTRACT

A swirler with integrated damper may include a primary swirler vane having a primary air passage, a secondary swirler vane having a secondary air passage, and a damper within the primary swirler vane, the secondary swirler vane, or both the primary swirler vane and the secondary swirler vane. The damper may include a series of cavities. The damper is configured to absorb one or more frequencies present in an air flow through the primary air passage, the secondary air passage, or both the primary air passage and the secondary air passage.

20 Claims, 9 Drawing Sheets

SWIRLER WITH INTEGRATED DAMPER

TECHNICAL FIELD

The present disclosure relates to a swirler for an engine. More particularly, the present disclosure relates to an integrated damper for a swirler.

BACKGROUND

A combustor of an engine may include a swirler for introducing air to the combustion section for mixing with a fuel flow. The swirler may be a radial swirler or an axial swirler. The swirler may include a primary swirler vane and a secondary swirler vane. The primary swirler vane may include a primary air passage and the secondary swirler vane may include a secondary swirler passage. Air may flow through each of the primary swirler passage and the secondary swirler passage. The air flows may mix with a fuel flow through a fuel nozzle. The fuel:air mixture may be provided to a combustor.

BRIEF SUMMARY

According to an embodiment, a swirler with integrated damper may include a swirler vane having a first sidewall and a second sidewall; an air passage defined between the first sidewall and the second sidewall; and a damper within the swirler vane, the damper comprising a series of cavities formed in the first sidewall, the second sidewall, or both the first sidewall and the second sidewall, wherein the damper is configured to absorb one or more frequencies present in an air flow through the air passage.

According to an embodiment, a swirler with integrated damper may include a primary swirler vane having a first sidewall and a second sidewall, the first sidewall and the second sidewall defining a primary air passage; and a damper within the primary swirler vane, the damper comprising: a first series of cavities extending along a length of the first sidewall; and a second series of cavities extending along a length of the second sidewall, wherein each cavity of the first series of cavities and the second series of cavities is in fluid communication with the primary air passage, and wherein the damper is configured to absorb one or more frequencies present in an air flow through the primary air passage.

Additional features, advantages, and embodiments of the present disclosure are set forth or apparent from a consideration of the following detailed description, drawings and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Various embodiments are discussed in detail below. While specific embodiments are discussed, this is done for illustration purposes only. A person skilled in the relevant art will recognize that other components and configurations may be used without departing from the spirit and scope of the present disclosure.

The swirlers with integrated damper of the present disclosure may provide a radial swirler or an axial swirler with a damper integrated therein. The damper may absorb or dampen acoustic waves present in the air flow through the swirler. The absorption or dampening of the acoustic waves may result in a smooth air flow with little to no fluctuations therein. The damper may be presented as a series of openings or cavities in a sidewall of the swirler vane, such as, for example, in the sidewall of the primary swirler vane. Each cavity may be sized, shaped, or dimensioned to absorb at least one frequency of acoustic wave present in the air flow. In this manner, multiple frequencies may be absorbed as the air flows through the damper resulting in a flow that exits the damper with fewer acoustic waves than when entering the damper. The cavities may progressively increase or decrease along the length of the damper.

Figure 1:
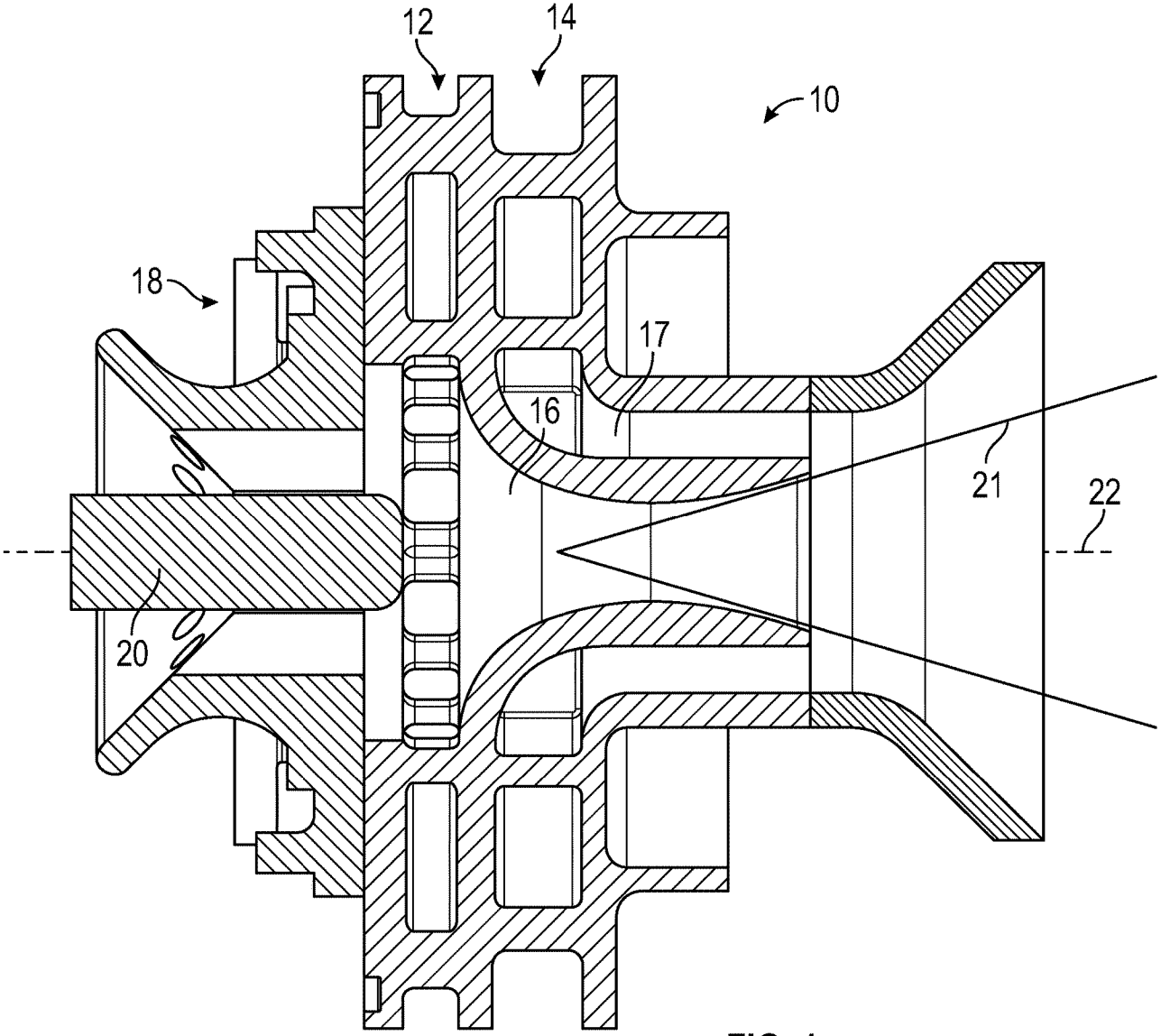
FIG. 1 shows a schematic, cross-sectional view of a swirler, taken along a centerline of the swirler, according to an embodiment of the present disclosure.

FIG. 1 shows a partial cross-sectional view of a swirler 10. The swirler 10 may be provided in a combustor, such as, for example, a gas turbine combustor. The swirler 10 may include a primary swirler vane 12 and a secondary swirler vane 14. The primary swirler vane 12 may include a primary air passage 16. The secondary swirler vane 14 may include a secondary air passage 17. A fuel nozzle 20 may be centered along the centerline 22. The fuel nozzle 20 may be centered with respect to the swirler 10. The swirler 10 may be centered by a ferrule 18 about the fuel nozzle 20.

The swirler 10 of FIG. 1 may be referred to as a radial swirler due to the radially extending primary swirler vane 12 and radially extending secondary swirler vane 14. A recirculation zone 21 may be present within the swirler 10. The recirculation zone 21 may oscillate due to hydrodynamic instability or due to thermoacoustic oscillations within the combustor.

Figure 2A:
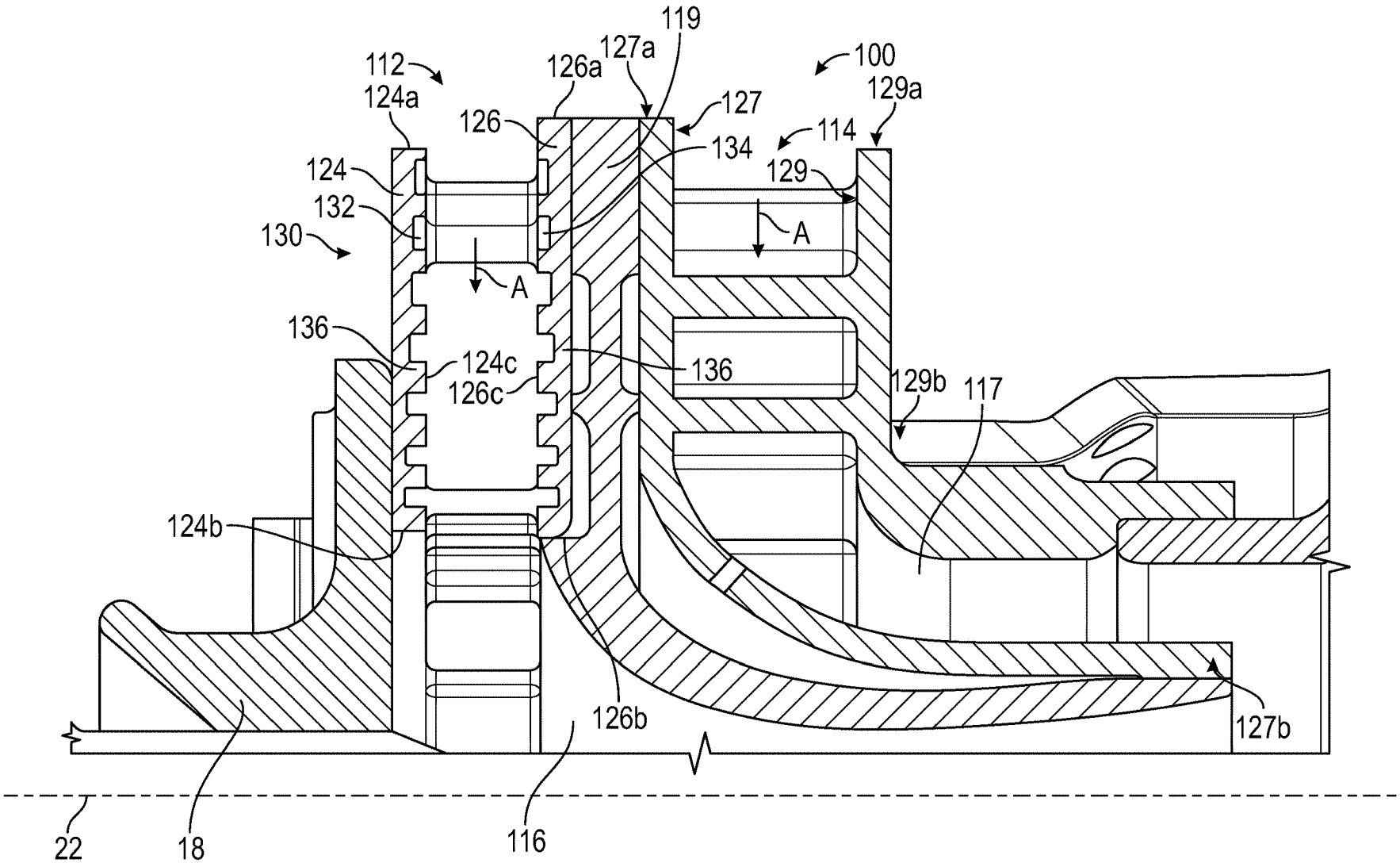
FIG. 2A shows a schematic, cross-sectional view of a swirler, taken along a centerline of the swirler, according to an embodiment of the present disclosure.
Figure 2B:
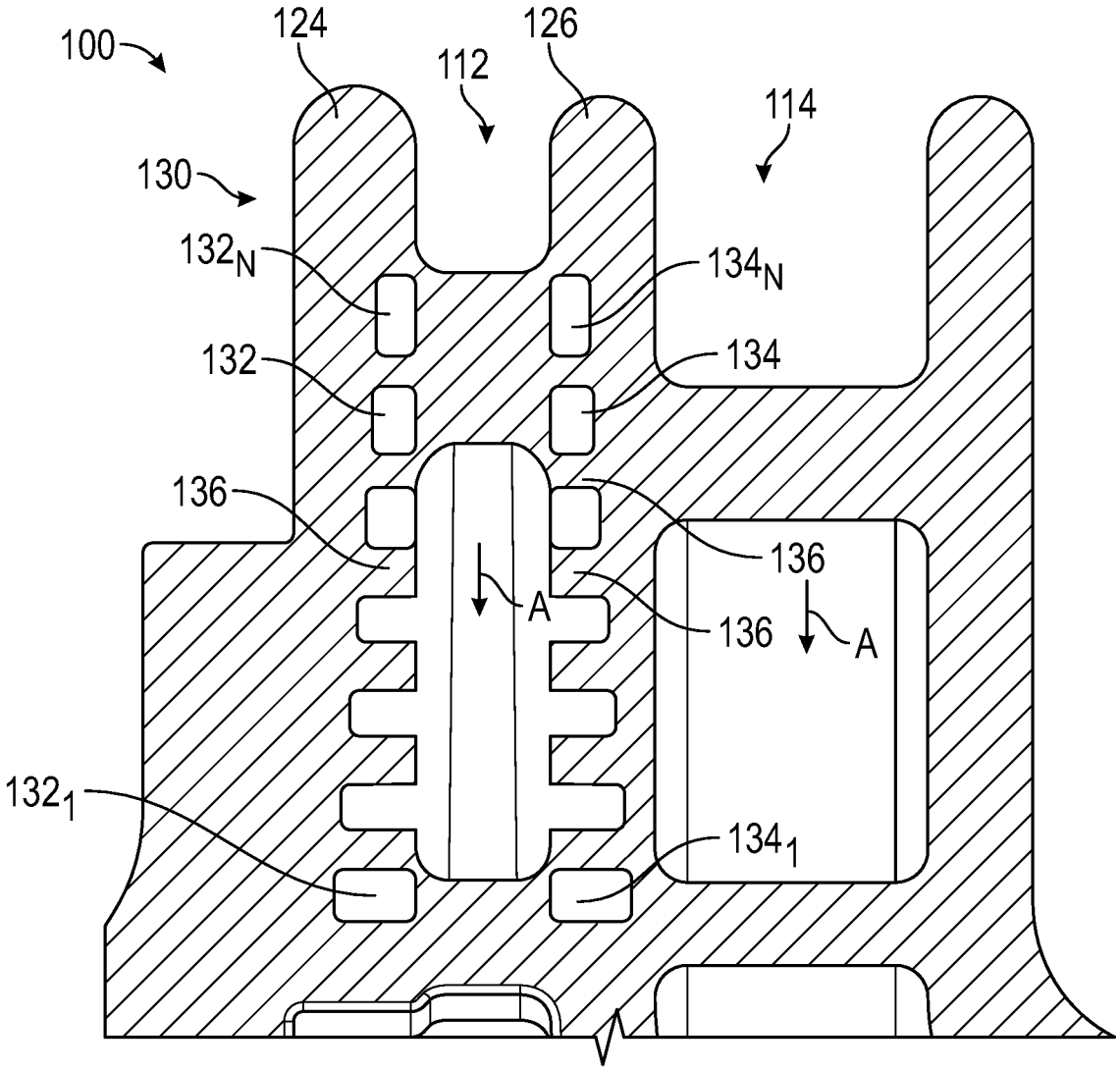
FIG. 2B shows a schematic, enlarged partial cross-sectional view of the swirler of FIG. 2A, according to an embodiment of the present disclosure.

FIGS. 2A and 2B show a swirler 100. The swirler 100 may be provided in a combustor, such as, for example, a gas turbine combustor. The swirler 100 may be a radial swirler.

Only a portion of the swirler 100 is visible in FIGS. 2A and 2B, however, the swirler 100 may be rotated circumferentially around the centerline 22 (such as shown in FIG. 1). Thus, a symmetrical, mirror image of the swirler 100 shown in FIG. 2A may also be present on the opposing side of the centerline 22. As in FIG. 1, the swirler 100 may be centered by a ferrule 18 around the fuel nozzle (not visible). The swirler 100 may include a primary swirler vane 112 and a secondary swirler vane 114. The primary swirler vane 112 may include a primary air passage 116. The secondary swirler vane 114 may include a secondary air passage 117. The primary swirler vane 112 and the secondary swirler vane 114 may be separated by a component 119 (FIG. 2A). Alternatively, the component 119 may be a part of (e.g., integral with) the primary swirler vane 112 (FIG. 2B).

The primary swirler vane 112 may include a first sidewall 124 and a second sidewall 126. The first sidewall 124 may include a first end 124*a* and a second end 124*b*. The first end 124*a* may be the radially outermost end surface of the first sidewall 124 and/or the primary swirler vane 112. The second end 124*b* may be the radially innermost end surface of the first sidewall 124 and/or the primary swirler vane 112. The second sidewall 126 may include a first end 126*a* and a second end 126*b*. The first end 126*a* may be the radially outermost end surface of the second sidewall 126 and/or the primary swirler vane 112. The second end 126*b* may be the radially innermost end surface of the second sidewall 126 and/or the primary swirler vane 112.

The secondary swirler vane 114 may include a first sidewall 127 and a second sidewall 129. The first sidewall 127 may include a first end 127*a* and a second end 127*b*. The first end 127*a* may be the radially outermost end surface of the first sidewall 127 and/or the secondary swirler vane 114. The second end 127*b* may be the radially innermost end surface of the first sidewall 127 and/or the secondary swirler vane 114. The second sidewall 129 may include a first end 129*a* and a second end 129*b*. The first end 129*a* may be the radially outermost end surface of the second sidewall 129 and/or the secondary swirler vane 114. The second end 129*b* may be the radially innermost end surface of the second sidewall 129 and/or the secondary swirler vane 114.

The swirler 100 may include a damper 130. Although shown on the primary swirler vane 112, the damper 130 may be placed on the secondary swirler vane 114 instead of, or in addition to, the primary swirler vane 112. The damper 130 may be quasi-periodic air columns on the sidewalls that present as air columns (e.g., openings 132, 134) between structures (e.g., portions 136). For example, the damper 130 may include a series of openings on the first sidewall 124, the second sidewall 126, or both the first sidewall 124 and the second sidewall 126 separated by portions 136 of the respective sidewall. The openings may be cavities, slots, indents, pockets, apertures, or other forms of openings formed in a body. As shown in FIG. 2A, the damper 130 includes a series of openings 132 on the first sidewall 124 and a series of openings 134 on the second sidewall 126. The series of openings 132 may be referred to as a series of cavities 132 and the series of opening 134 may be referred to as a series of cavities 134. Each opening of the series of openings 132 and 134 may be separated from adjacent openings by the portion 136 of the respective sidewall. The openings 132 may be formed on an inner face 124*c* of the first sidewall 124. The inner face 124*c* may be a surface that defines at least a portion of the primary air passage 116. The openings 134 may be formed on an inner face 126*c* of the second sidewall 126. The inner face 126*c* may be a surface that defines at least a portion of the secondary air passage 117. The openings 132 and 134 may be discrete openings that are not fluidly coupled to adjacent openings. The openings 132 and 134 may be openings that extend a finite distance into and that do not extend the full width of the first sidewall 124 and second sidewall 126, respectively.

With reference to FIG. 2B, a close up view of the damper 130 shows the series of openings 132 and the series of openings 134. The series of openings 132 on the first sidewall 124 may extend from a first opening $\mathbf{132}_1$ to a final opening $\mathbf{132}_N$. The series of openings 134 on the second sidewall 126 may extend from a first opening $\mathbf{134}_1$ to a final opening $\mathbf{134}_N$. "N" may be representative of the number of openings 132 and 134 provided in the damper 130. FIG. 2B depicts seven openings 132 and seven openings 134, however more or fewer may be provided. The number of openings 132 may be the same as, fewer than, or more than, the number of openings 134.

Referring again to FIGS. 2A and 2B, the series of openings 132 may gradually increase in height (e.g., H in FIG. 3) from the first end 124*a* to the second end 124*b*. That is, the first opening $\mathbf{132}_1$ may have a greater height than the final opening $\mathbf{132}_N$. The series of openings 132 may gradually decrease in width (e.g., W in FIG. 3) from the first end 124*a* to the second end 124*b*. That is, the first opening $\mathbf{132}_1$ may have a lesser width than the final opening $\mathbf{132}_N$. In some examples, the height of the openings may increase as the width of the openings decreases. Although the openings are shown as gradually increasing in height and decreasing in width from the first end 124*a* to the second end 124*b*, the damper 130 may be reversed such that the openings gradually decrease in height and increase in width from the first end 124*a* to the second end 124*b*.

With continued reference to FIGS. 2A and 2B, the series of openings 134 may gradually increase in height (e.g., H in FIG. 3) from the first end 126*a* to the second end 126*b*. That is, the first opening $\mathbf{134}_1$ may have a greater height than the final opening $\mathbf{134}_N$. The series of openings 132 may gradually decrease in width (e.g., W in FIG. 3) from the first end 126*a* to the second end 126*b*. That is, the first opening $\mathbf{134}_1$ may have a lesser width than the final opening $\mathbf{134}_N$. The series of openings 132 and the series of openings 134 may have openings that increase or decrease in height with a linear profile from the first opening $\mathbf{132}_1$, $\mathbf{134}_1$ to the final openings $\mathbf{132}_N$, $\mathbf{134}_N$.

In some examples, the height of the openings may increase as the width of the openings decreases. Although the openings are shown as gradually increasing in height and decreasing in width from the first end 126*a* to the second end 126*b*, the damper 130 may be reversed such that the openings gradually decrease in height and increase in width from the first end 126*a* to the second end 126*b*.

Although FIGS. 2A and 2B show the openings 132 and 134 changing in the same direction (e.g., increasing in height/decreasing in width from the first end to the second end), the openings 132 and 134 may change in opposing directions and/or in different patterns. For example, the openings 132 may increase in height while the openings 134 decrease in height, or vice versa. Any alterations or patterns may be provided to the openings 132 and 134, either in the same or different manners, to achieve the desired dampening of the damper 130.

During operation, an air flow A may flow through the primary air passage 116 and the secondary air passage 117. Acoustic fluctuations and/or sound waves may be present in the air flow A. As the air flow A passes the openings 132 and the openings 134, the acoustic fluctuations may be absorbed by the opening. As the air flow A continues to flow through the primary air passage 116 and the secondary air passage 117, acoustic fluctuations continue to be absorbed by each opening of the series of openings. When the air flow A passes the final opening of the series of openings and exits the primary air passage 116 and secondary air passage 117, all, or substantially all, of the acoustic fluctuations may be absorbed or dampened such that the air flow A exiting the swirler vane passages may be smooth (e.g., an air flow with little or no acoustic fluctuations). That is, as the air flow A flows through the damper 130, the acoustic waves within the air flow are dissipated by the cavities or openings 132 and 134. The air flow A may thus be stabilized with the amplitude of the acoustic waves dampened as flow proceeds though the swirler vane passages.

Figure 3:
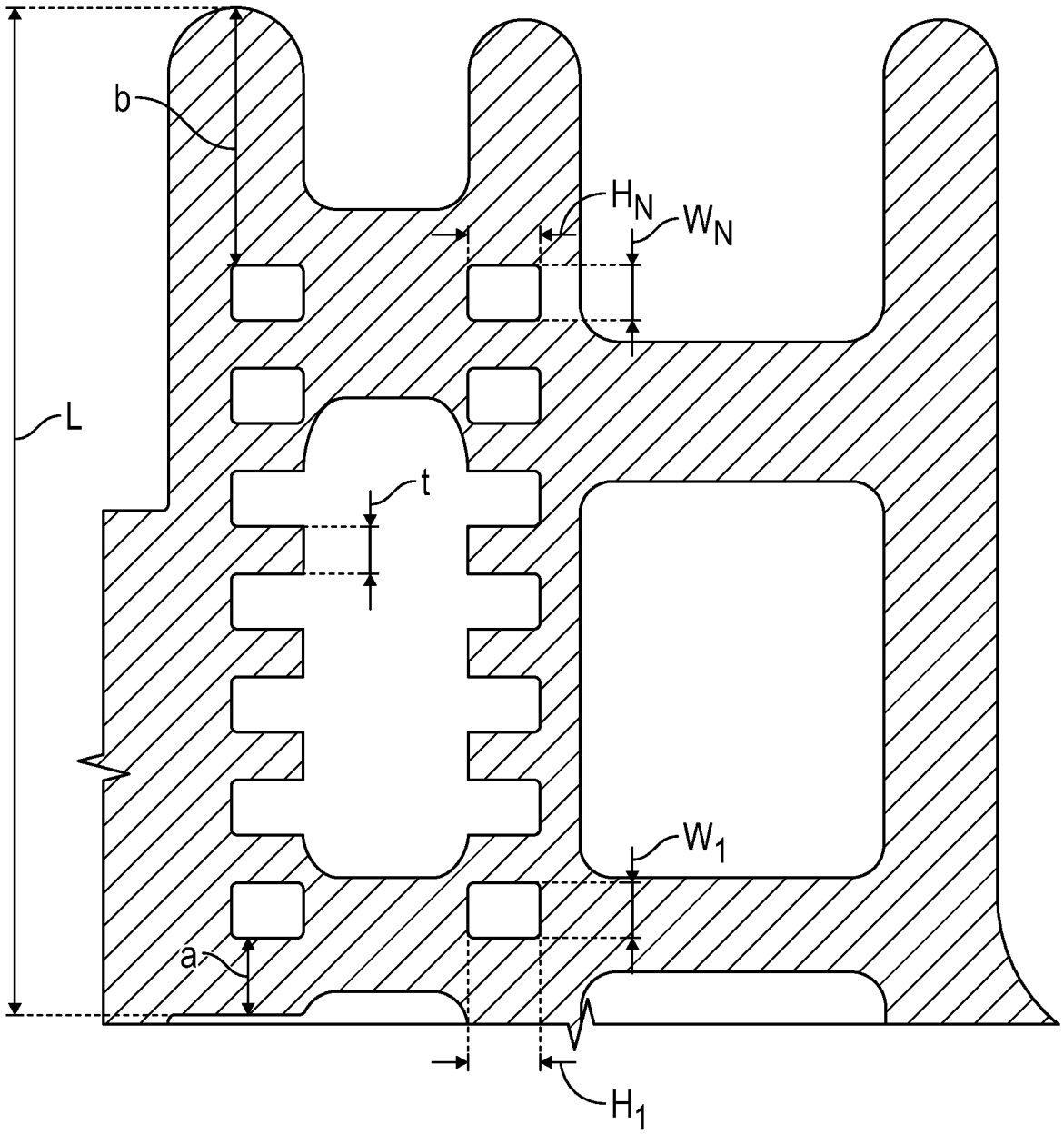
FIG. 3 shows a schematic, partial cross-sectional view of a swirler, according to an embodiment of the present disclosure.

FIG. 3 shows a schematic of a damper having a variety of parameters. For example, the damper may include a series of openings or cavities, as previously described. Each opening of the series may include a width W and a height H. The first opening may have a width $W_1$ and a height $H_1$. The last opening may have a width $W_N$ and a height $H_N$. One or more, or all, of the dimensions (e.g., width and/or height) of the first opening may be the same or different as the last opening. In some examples, the dimensions may change gradually from the first opening to the last opening. That is, the dimensions may gradually increase and/or gradually decrease from the first opening to the last opening. In some examples, the dimensions may alternate in a pattern such that every other (or every two, every three, etc.) opening as the same dimension. In some examples, the openings on the first sidewall and the second sidewall may change in the same manner or in different manners.

With continued reference to FIG. 3, the first opening may be located a distance a from the radially innermost end surface (e.g., second end 124*b* of FIG. 2A) of the swirler. The last opening may be located a distance b from the radially outermost end surface (e.g., first end 124*a* of FIG. 2A) of the swirler. The distance between the openings may be occupied by a portion of the sidewall. This portion of the sidewall may have a thickness t. The thickness t may be a minimum metal thickness. The damper may extend along a length L of the swirler vanes. The distance a may be greater than or equal to 1/10 of the length L. The distance b may be equal to or about equal to 1/10 of the length L. In some examples, the thickness t may be greater than or equal to 20 mils. In some examples, the width may increase in a manner to satisfy Equation 1, where N represents the number of openings present in the damper and G represents a multiplier. In some examples, the multiplier G may be 1.1.

$$W_N = W_1 * G^{N-1} \qquad \text{Equation 1}$$

Figure 4:
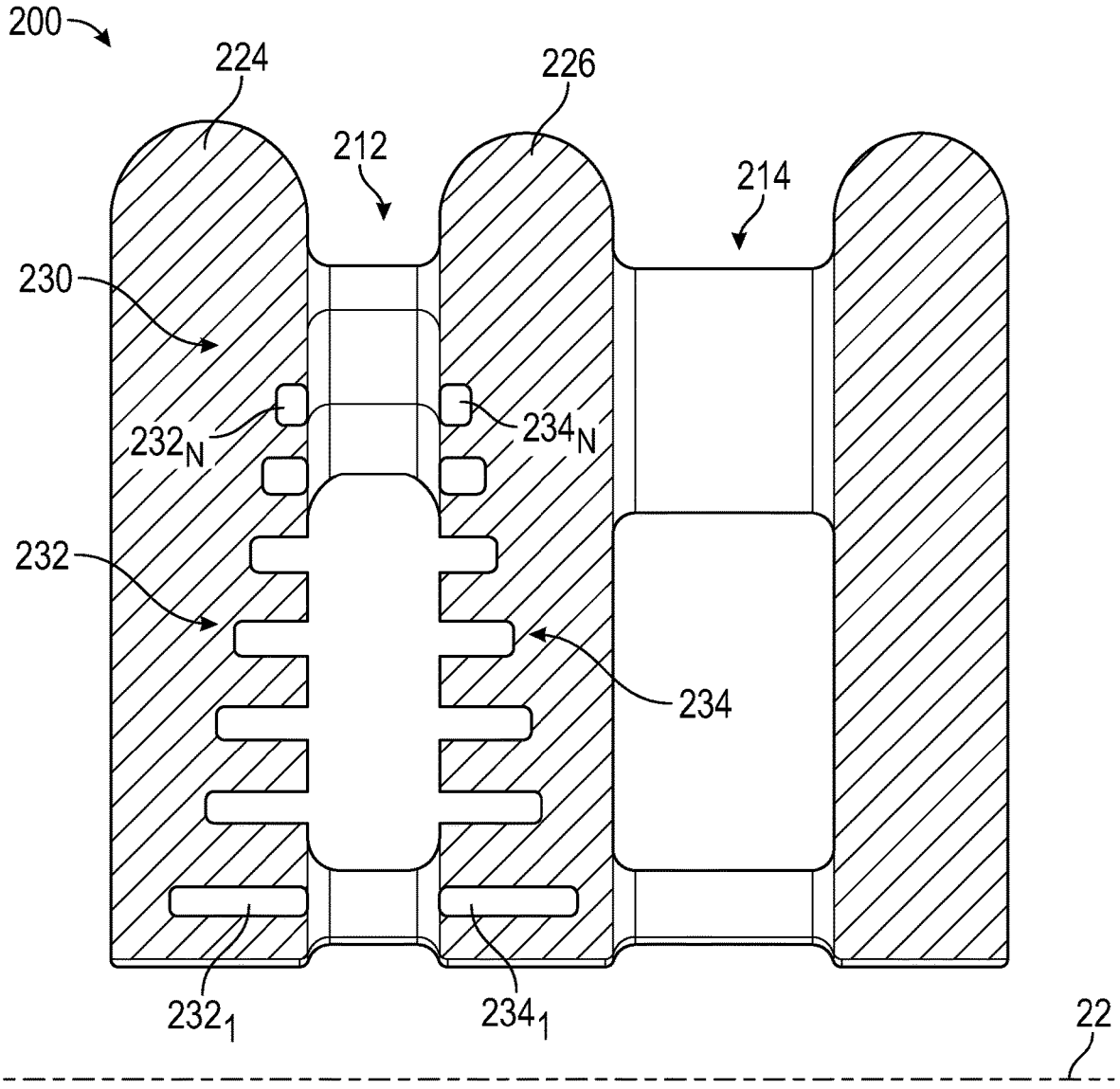
FIG. 4 shows a schematic, partial view of a swirler, according to an embodiment of the present disclosure.

Referring to FIG. 4, a swirler 200 may include a damper 230. The swirler 200 may be the same as, or similar to, the swirlers 10 and/or 100. The swirler 200 may include a primary swirler vane 212 having a first sidewall 224 and a second sidewall 226. The swirler 200 may include a secondary swirler vane 214. As described with respect to FIGS. 2A, 2B, and 3, the damper 230 may include a series of openings 232 and a series of openings 234. The series of openings 232 may extend from a first opening $\mathbf{232}_1$ to a final opening $\mathbf{232}_N$. The series of openings 234 may extend from a first opening $\mathbf{234}_1$ to a final opening $\mathbf{234}_N$. The series of openings 232 and the series of openings 234 may have openings that decrease in height (e.g., H in FIG. 3) with a non-linear profile (e.g., according to a power law) from the first opening $\mathbf{232}_1$, $\mathbf{234}_1$ to the final openings $\mathbf{232}_N$, $\mathbf{234}_N$.

Figure 5A:
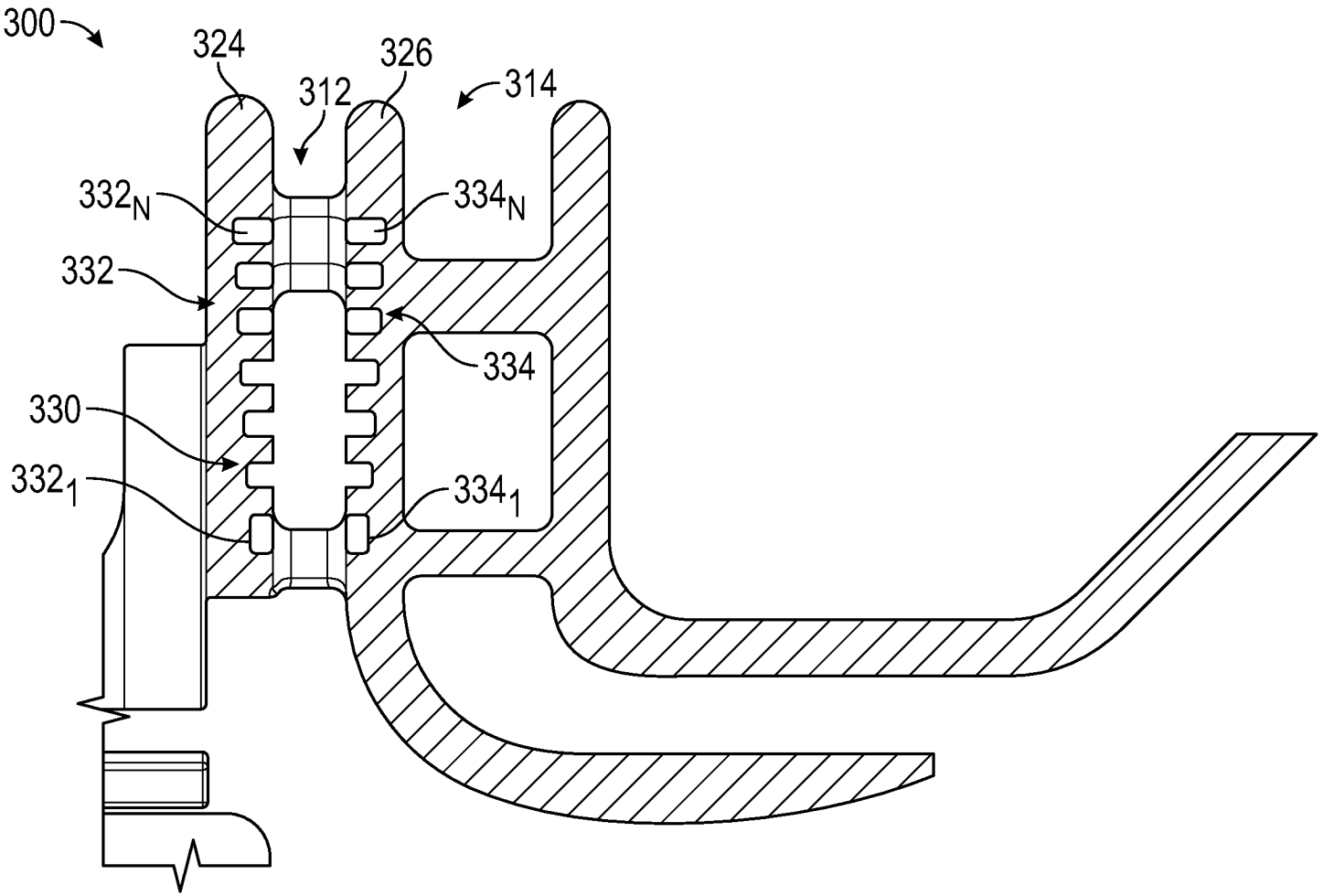
FIG. 5A shows a schematic, partial view of a swirler, according to an embodiment of the present disclosure.
Figure 5B:
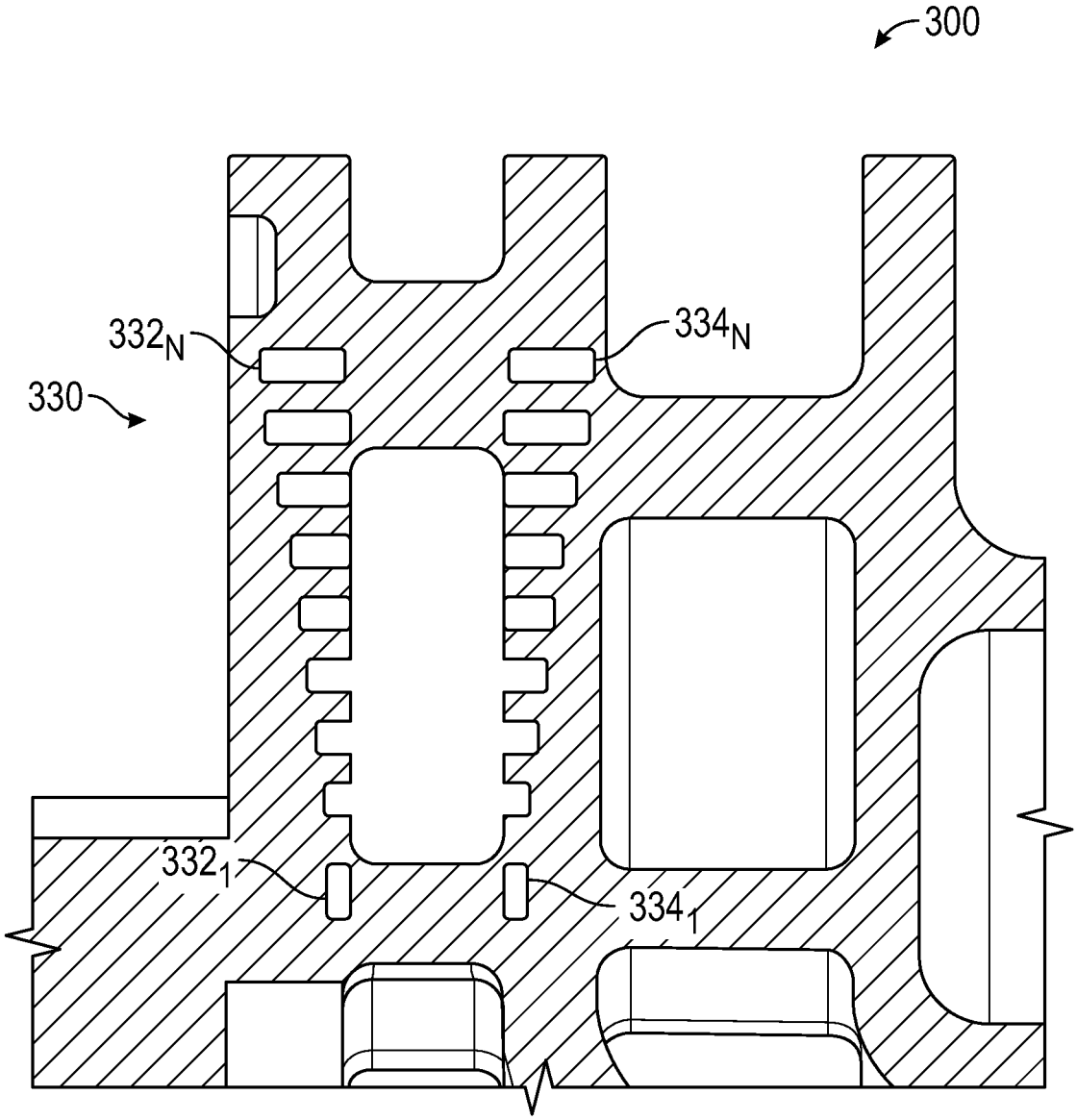
FIG. 5B shows a schematic, partial cross-sectional view of the swirler of FIG. 5A, taken along a centerline of the swirler, according to an embodiment of the present disclosure.

Referring to FIGS. 5A and 5B, a swirler 300 may include a damper 330. The swirler 300 may be the same as, or similar to, the swirlers 10, 100, and/or 200. The swirler 300 may include a primary swirler vane 312 having a first sidewall 324 and a second sidewall 326. The swirler 300 may include a secondary swirler vane 314. As described with respect to FIGS. 2A, 2B, and 3, the damper 330 may include a series of openings 332 and a series of openings 334. The series of openings 332 may extend from a first opening $\mathbf{332}_1$ to a final opening $\mathbf{332}_N$. The series of openings 334 may extend from a first opening $\mathbf{334}_1$ to a final opening $\mathbf{334}_N$. The series of openings 332 and the series of openings 334 may have openings that increase in height (e.g., H in FIG. 3) with a linear profile from the first opening $\mathbf{132}_1$, $\mathbf{134}_1$ to the final openings $\mathbf{132}_N$, $\mathbf{134}_N$. Although as shown having an increase with a linear profile, the increase may be a non-linear increase.

Figure 6:
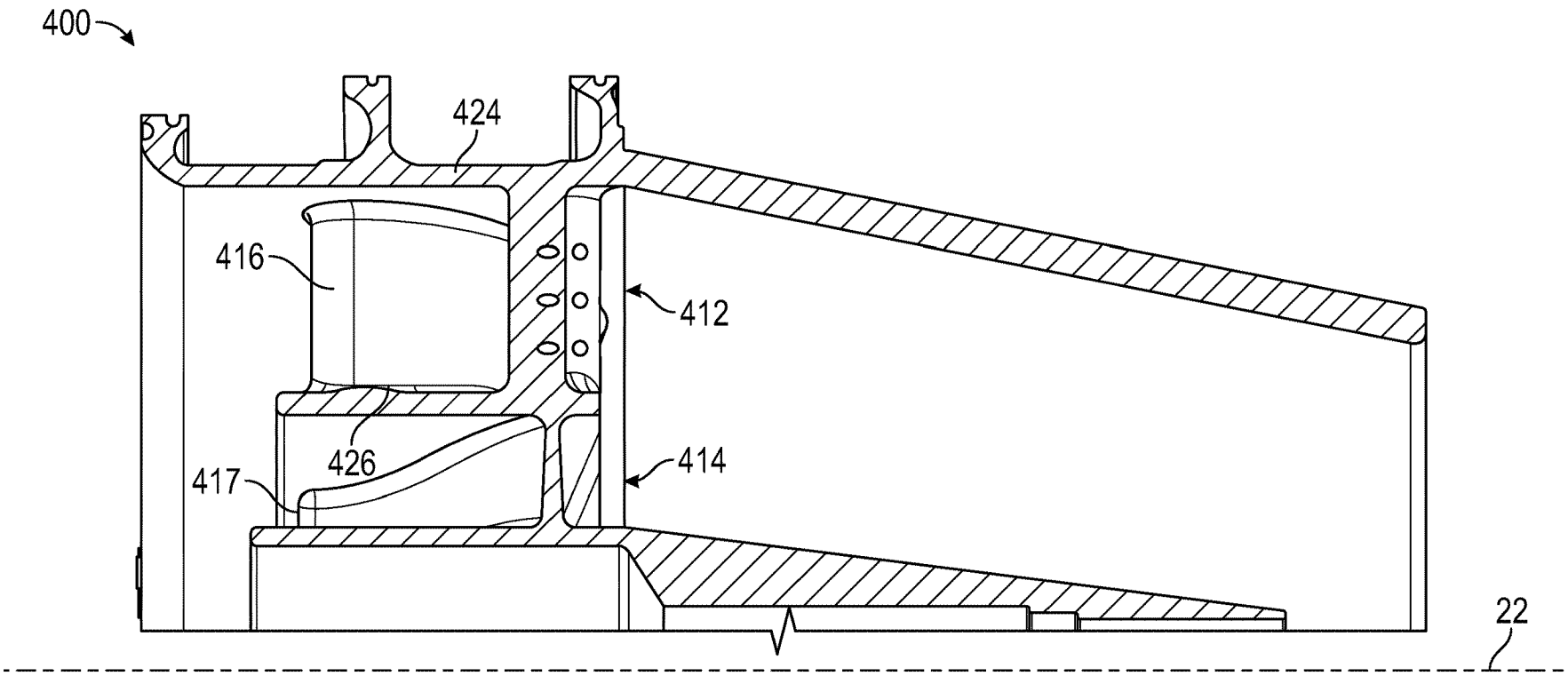
FIG. 6 shows a schematic, cross-sectional view of a swirler, taken along a centerline of the swirler, according to an embodiment of the present disclosure.

FIG. 6 shows a partial cross-sectional view of a swirler 400. The swirler 400 may be provided in a combustor, such as, for example, a gas turbine combustor. The swirler 400 may include a primary swirler vane 412 and a secondary swirler vane 414. The primary swirler vane 412 may include a primary air passage 416. The secondary swirler vane 414 may include a secondary air passage 417. A fuel nozzle (not visible) may be centered along the centerline 22. The fuel nozzle may be centered with respect to the swirler 400. The primary swirler vane 412 may include a first sidewall 424 and a second sidewall 426.

The swirler 400 of FIG. 6 may be referred to as an axial swirler due to the axially extending primary swirler vane 412 and axially extending secondary swirler vane 414. As in the radial swirler of the prior figures, acoustic fluctuations may be present within the primary air passage 416 and the secondary air passage 417. Only a portion of the swirler 400 is visible in FIG. 6, however, the swirler 400 may be rotated circumferentially around the centerline 22 (such as shown in FIG. 1). Thus, a symmetrical, mirror image of the swirler 400 shown in FIG. 6 may also be present on the opposing side of the centerline 22.

Figure 7:
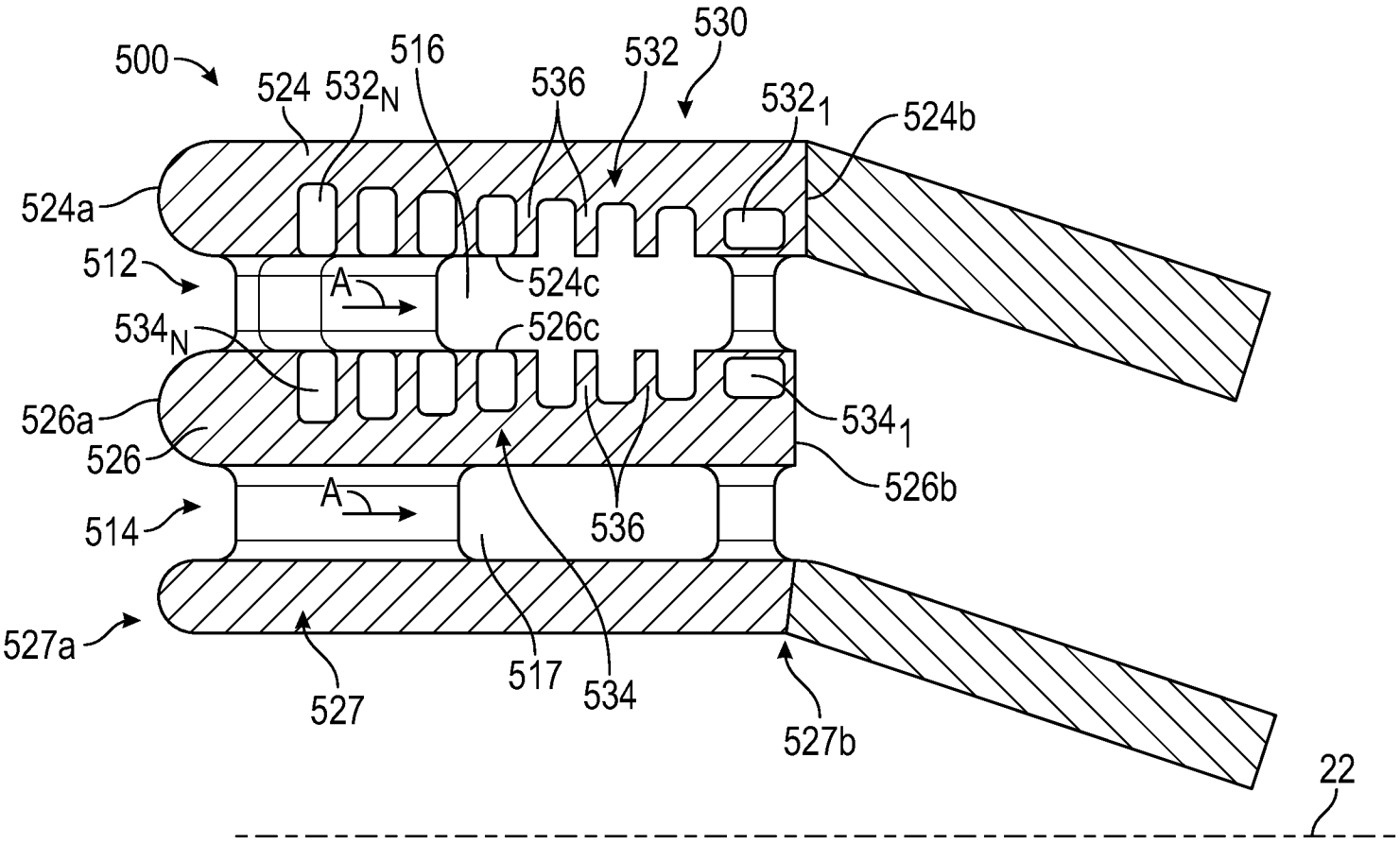
FIG. 7 shows a schematic, partial view of a swirler, according to an embodiment of the present disclosure.

Referring to FIG. 7, an axial swirler 500 may include a primary swirler vane 512 and a secondary swirler vane 514. The primary swirler vane 512 may include a first sidewall 524 and a second sidewall 526. The first sidewall 524 may include a first end 524*a* and a second end 524*b*. The first end 524*a* may be the axially aft end surface of the first sidewall 524 and/or the primary swirler vane 512. The second end 524*b* may be the axially forward end surface of the first sidewall 524 and/or the primary swirler vane 512. The second sidewall 526 may include a first end 526*a* and a second end 526*b*. The first end 526*a* may be the axially aft end surface of the second sidewall 526 and/or the primary swirler vane 512 and/or the secondary swirler vane 514. The second end 526*b* may be the axially forward end surface of the second sidewall 526 and/or the primary swirler vane 512 and/or the secondary swirler vane 514. The secondary swirler vane 514 may include the second sidewall 526 and a third sidewall 527. The third sidewall 527 may include a first end 527*a* and a second end 527*b*. The first end 527*a* may be the axially aft end surface of the third sidewall 527 and/or the secondary swirler vane 514. The second end 527*b* may be the axially forward end surface of the third sidewall 527 and/or the secondary swirler vane 514.

The axial swirler 500 may include a damper 530. Although shown on the primary swirler vane 512, the damper 530 may be placed on the secondary swirler vane 514 instead of, or in addition to, the primary swirler vane 512. The damper 530 may be quasi-periodic air columns on the sidewalls that present as air columns (e.g., openings 532, 534) between structures (e.g., portions 536). For example, the damper 530 may include a series of openings on the first sidewall 524, the second sidewall 526, or both the first sidewall 524 and the second sidewall 526 separated by portions 536 of the respective sidewall. The openings may be cavities, slots, indents, pockets, apertures, or other forms of openings formed in a body. The damper 530 includes a series of openings 532 on the first sidewall 524 and a series of openings 534 on the second sidewall 526. The openings 532 may be formed on an inner face 524*c* of the first sidewall 524. The inner face 524*c* may be a surface that defines at least a portion of the primary air passage 516. The openings 534 may be formed on an inner face 526*c* of the second sidewall 526. The inner face 526*c* may be a surface that defines at least a portion of the secondary air passage 517. The openings 532 and 534 may be discrete openings that are not fluidly coupled to adjacent openings.

The series of openings 532 on the first sidewall 524 may extend from a first opening $\mathbf{532}_1$ to a final opening $\mathbf{532}_N$. The series of openings 534 on the second sidewall 526 may extend from a first opening $\mathbf{534}_1$ to a final opening $\mathbf{534}_N$. "N" may be representative of the number of openings 532 and 534 provided in the damper 530. FIG. 7 depicts eight openings 532 and eight openings 534, however more or fewer may be provided. The number of openings 532 may be the same as, fewer than, or more than, the number of openings 534.

Any of the variations of the dampers and/or openings described with respect to FIG. 2A, 2B, 3, 4, 5A, or 5B may be applied to the damper 530 and/or the axial swirler 500. In the case of FIG. 7, the increase and decrease may extend in the axial direction (as opposed to the radial direction as described with respect to FIGS. 2A, 2B, 3, 4, 5A, and 5B). The particular profile and variations in dimensions may be selected to achieve a desired dampening of the damper 530.

During operation, an air flow A may flow through the primary air passage 516 and the secondary air passage 517. Acoustic fluctuations and/or sound waves may be present in the air flow A. As the air flow A passes the openings 532 and the openings 534, the acoustic fluctuations may be absorbed by the opening. As the air flow A continues to flow through the primary air passage 516 and the secondary air passage 517, acoustic fluctuations continue to be absorbed by each opening of the series of openings. When the air flow A passes the final opening of the series of openings and exits the primary air passage 516 and secondary air passage 517, all, or substantially all, of the acoustic fluctuations may be absorbed or dampened such that the air flow A exiting the swirler vane passages may be smooth (e.g., an air flow with little or no acoustic fluctuations). That is, as the air flow A flows through the damper 530, the acoustic waves within the air flow are dissipated by the cavities or openings 532 and 534. The air flow A may thus be stabilized with the amplitude of the acoustic waves dampened as flow proceeds though the swirler vane passages.

The swirlers with integrated damper of the present disclosure may be employed in any of aircraft or aviation engines, marine engines, and industrial engines. The cavities of the damper of the present disclosure may vary according to any pattern to achieve the desired dampening of the air flow. Some exemplary patterns of variation may include, for example, but not limited to, varying linearly, nonlinearly, by power law, quadratically, quasi-periodic, by geometric progression, or any combination thereof. Alternatively, the openings may be constant across the damper and may not vary in dimension. In some examples, the openings may include both varying and constant dimensions. For example, the overall profile of the openings may increase or decrease (e.g., non-linearly) with two adjacent openings having constant dimensions (e.g., first two openings have the same dimensions, next two openings are the same, but are increased or decreased in dimension as compared to the first two openings, etc.). Any pattern, size alteration, or variance between openings may be provided based on the frequency to be dampened.

The damper of the present disclosure may be provided in a radial swirler (e.g., FIG. 1) or an axial swirler (e.g., FIG. 6). The damper of the present disclosure may be formed with additive manufacturing. The dampers of the present disclosure may include openings or cavities having a predetermined width and height, both of which may or may not vary. The damper may include a predetermined profile. The number of openings in the damper may vary. The shape of the openings in the damper may be any shape. The aforementioned parameters may be selected for a damper or swirler based on the frequencies to be dampened in the flow and/or based on the desired flow and operation characteristics. Any of the variations, applications, or alterations described herein may be provided to any of the disclosed dampers. Any of the dampers may be combined with other dampers, or features of various dampers may be combined with other dampers. Any of the dampers of the present disclosure may be provided on the primary vane, the secondary vane, or both the primary vane and the secondary vane.

The swirlers with integrated damper of the present disclosure address detrimental dynamics associated with a swirl stabilized combustor. The dynamics may affect combustor durability if the frequencies of vibration within the swirler match the modes of the combustor. The integrated damper of the swirler of the present disclosure mitigates swirler dynamics and may help stabilize the flame in a combustor.

The swirlers with integrated damper of the present disclosure allow the air flow through the primary swirler vane passage to be smoothed along the flow direction as the air flow enters the central passageway. That is, the acoustic wave due to the recirculation zone that is present in the air flow may be dampened by the openings to provide a smoother, more uniform flow. The velocity of the acoustic wave present in the air flow decreases smoothly along the damper (e.g., due to the admittance changing smoothly through the vanes) and after a predetermined length of the damper, near compete absorption of the acoustic wave in the flow may be achieved.

The swirlers with integrated damper of the present disclosure may provide mitigation of combustion dynamics that may lead to reduced durability issues and may assist in optimal operation of the combustor and thus the engine. The swirlers with integrated damper of the present disclosure allow for oscillations within the combustor flow to be isolated from affecting the compressor operation. The swirlers provide a damper having a geometry that may absorb or dampen acoustic waves within the air flow of the swirler.

The dampers of the present disclosure may absorb or dampen one or more frequencies present within the swirler. Multiple different frequencies may be dampened with a single damper due to the variations in openings present within the damper. The profile, height, width, or other parameters of the openings may be tuned for a particular frequency experienced in the air flow. The parameters may be selected to target a particular frequency. The parameters may be adjusted to target a particular frequency.

Further aspects of the present disclosure are provided by the subject matter of the following clauses.

A swirler with integrated damper comprising: a swirler vane having a first sidewall and a second sidewall; an air passage defined between the first sidewall and the second sidewall; and a damper within the swirler vane, the damper comprising a series of cavities formed in the first sidewall, the second sidewall, or both the first sidewall and the second sidewall, wherein the damper is configured to absorb one or more frequencies present in an air flow through the air passage.

The swirler of any preceding clause, further comprising a primary swirler vane and a secondary swirler vane, and wherein the swirler vane is the primary swirler vane and the air passage is a primary air passage.

The swirler of any preceding clause, further comprising a primary swirler vane and a secondary swirler vane, and wherein the swirler vane is the secondary swirler vane and the air passage is a secondary air passage.

The swirler of any preceding clause, wherein the series of cavities extends from a radially outermost end of the swirler vane to a radially innermost end of the swirler vane.

The swirler of any preceding clause, wherein each cavity of the series of cavities includes a height and a width.

The swirler of any preceding clause, wherein the height of each cavity of the series of cavities increases or decreases linearly from the radially outermost end to the radially innermost end.

The swirler of any preceding clause, wherein the height of each cavity of the series of cavities increases or decreases non-linearly from the radially outermost end to the radially innermost end.

The swirler of any preceding clause, wherein the height of each cavity of the series of cavities is constant from the radially outermost end to the radially innermost end.

The swirler of any preceding clause, wherein the series of cavities extends from an axially aft end to an axially forward end.

The swirler of any preceding clause, wherein each cavity of the series of cavities includes a height and a width.

The swirler of any preceding clause, wherein the height of each cavity of the series of cavities increases or decreases linearly from the axially aft end to the axially forward end.

The swirler of any preceding clause, wherein the height of each cavity of the series of cavities increases or decreases non-linearly from the axially aft end to the axially forward end.

The swirler of any preceding clause, wherein the height of each cavity of the series of cavities is constant from the axially aft end to the axial forward end.

A swirler with integrated damper comprising: a primary swirler vane having a first sidewall and a second sidewall, the first sidewall and the second sidewall defining a primary air passage; and a damper within the primary swirler vane, the damper comprising: a first series of cavities extending along a length of the first sidewall; and a second series of cavities extending along a length of the second sidewall, wherein each cavity of the first series of cavities and the second series of cavities is in fluid communication with the primary air passage, and wherein the damper is configured to absorb one or more frequencies present in an air flow through the primary air passage.

The swirler of any preceding clause, wherein the first series of cavities comprises a first profile and the second series of cavities comprises a second profile.

The swirler of any preceding clause, wherein the first profile and the second profile are the same and wherein the first profile and the second profile both increase linearly, decrease linearly, increase non-linearly, decrease non-linearly, or are constant from a radially outermost end to a radially innermost end of the primary swirler vane.

The swirler of any preceding clause, wherein the first profile and the second profile are different.

The swirler of any preceding clause, wherein the first profile increases in height linearly from a radially outermost end of the first sidewall to a radially innermost end of the first sidewall and wherein the second profile increases in height linearly from a radially outermost end of the second sidewall to a radially innermost end of the second sidewall.

The swirler of any preceding clause, wherein the first series of cavities extends from a radially outermost end to a radially innermost end of the primary swirler vane, and wherein the second series of cavities extends from the radially outermost end to the radially innermost end.

The swirler of any preceding clause, wherein the first series of cavities extends from an axially aft end to an axially forward end, and wherein the second series of cavities extends from the axially aft end to the axially forward end.

Although the foregoing description is directed to the preferred embodiments, it is noted that other variations and modifications will be apparent to those skilled in the art, and may be made without departing from the spirit or scope of the disclosure Moreover, features described in connection with one embodiment may be used in conjunction with other embodiments, even if not explicitly stated above.

The invention claimed is:

1. A swirler with integrated damper comprising:

a swirler vane having a first sidewall and a second sidewall;

an air passage defined between the first sidewall and the second sidewall; and a damper within the swirler vane, the damper comprising a series of cavities formed in the first sidewall, the second sidewall, or both the first sidewall and the second sidewall, wherein the damper is configured to absorb one or more frequencies present in an air flow through the air passage.

2. The swirler with integrated damper of claim 1, further comprising a primary swirler vane and a secondary swirler vane, and wherein the swirler vane is the primary swirler vane and the air passage is a primary air passage.

3. The swirler with integrated damper of claim 1, further comprising a primary swirler vane and a secondary swirler vane, and wherein the swirler vane is the secondary swirler vane and the air passage is a secondary air passage.

4. The swirler with integrated damper of claim 1, wherein the series of cavities extends from a radially outermost end of the swirler vane to a radially innermost end of the swirler vane.

5. The swirler with integrated damper of claim 4, wherein each cavity of the series of cavities includes a height and a width.

6. The swirler with integrated damper of claim 5, wherein the height of each cavity of the series of cavities increases or decreases linearly from the radially outermost end to the radially innermost end.

7. The swirler with integrated damper of claim 5, wherein the height of each cavity of the series of cavities increases or decreases non-linearly from the radially outermost end to the radially innermost end.

8. The swirler with integrated damper of claim 5, wherein the height of each cavity of the series of cavities is constant from the radially outermost end to the radially innermost end.

9. The swirler with integrated damper of claim 1, wherein the series of cavities extends from an axially aft end to an axially forward end.

10. The swirler with integrated damper of claim 9, wherein each cavity of the series of cavities includes a height and a width.

11. The swirler with integrated damper of claim 10, wherein the height of each cavity of the series of cavities increases or decreases linearly from the axially aft end to the axially forward end.

12. The swirler with integrated damper of claim 10, wherein the height of each cavity of the series of cavities increases or decreases non-linearly from the axially aft end to the axially forward end.

13. The swirler with integrated damper of claim 10, wherein the height of each cavity of the series of cavities is constant from the axially aft end to the axial forward end.

14. A swirler with integrated damper comprising:

a primary swirler vane having a first sidewall and a second sidewall, the first sidewall and the second sidewall defining a primary air passage; and a damper within the primary swirler vane, the damper comprising:

a first series of cavities extending along a length of the first sidewall; and a second series of cavities extending along a length of the second sidewall, wherein each cavity of the first series of cavities and the second series of cavities is in fluid communication with the primary air passage, and wherein the damper is configured to absorb one or more frequencies present in an air flow through the primary air passage.

15. The swirler with integrated damper of claim 14, wherein the first series of cavities comprises a first profile and the second series of cavities comprises a second profile.

16. The swirler with integrated damper of claim 15, wherein the first profile and the second profile are the same and wherein the first profile and the second profile both increase linearly, decrease linearly, increase non-linearly, decrease non-linearly, or are constant from a radially outermost end to a radially innermost end of the primary swirler vane.

17. The swirler with integrated damper of claim 15, wherein the first profile and the second profile are different.

18. The swirler with integrated damper of claim 15, wherein the first profile increases in height linearly from a radially outermost end of the first sidewall to a radially innermost end of the first sidewall and wherein the second profile increases in height linearly from a radially outermost end of the second sidewall to a radially innermost end of the second sidewall.

19. The swirler with integrated damper of claim 14, wherein the first series of cavities extends from a radially outermost end to a radially innermost end of the primary swirler vane, and wherein the second series of cavities extends from the radially outermost end to the radially innermost end.

20. The swirler with integrated damper of claim 14, wherein the first series of cavities extends from an axially aft end to an axially forward end, and wherein the second series of cavities extends from the axially aft end to the axially forward end.

* * * * *